United States Patent [19]

Bijaoui et al.

[11] Patent Number: 5,000,251

[45] Date of Patent: Mar. 19, 1991

[54] METHODS AND APPARATUS FOR OBTAINING WIRES OF AMORPHOUS METALLIC ALLOYS

[75] Inventors: Denis Bijaoui, Riom; Gerard Duchefdelaville, Clermont-Ferrand; Guy Jarrige, Cournon-d'Auvergne, all of France

[73] Assignee: Compagnie Generale des Etablissements Michelin-Michelin & Cie, Clermont-Ferrand Cedex, France

[21] Appl. No.: 407,860

[22] Filed: Sep. 15, 1989

[30] Foreign Application Priority Data

Sep. 21, 1988 [FR] France ..... 88 12423

[51] Int. Cl.[5] ..... B22D 11/00

[52] U.S. Cl. ..... 164/462; 164/463; 164/423; 164/475

[58] Field of Search ..... 164/462, 463, 479, 423, 164/429, 475, 415

[56] References Cited

U.S. PATENT DOCUMENTS 3,845,805 1/1974 Kavesh .
4,131,151 12/1978 Pflieger .
4,153,099 5/1979 Pflieger et al. ..... 164/462
4,339,255 7/1982 Ovshinsky .
4,523,626 6/1985 Masumoto .
4,607,683 8/1986 Hamashima et al. ..... 164/463
4,617,983 10/1986 Tsubata .

FOREIGN PATENT DOCUMENTS 0163226 12/1985 European Pat. Off. .
3135374 9/1982 Fed. Rep. of Germany .
2367563 5/1978 France .

*Primary Examiner*—Kuang Y. Lin
*Attorney, Agent, or Firm*—Brumbaugh, Graves, Donohue & Raymond

[57] ABSTRACT

Method and apparatus (20) for obtaining a wire (12) of amorphous metallic alloy, characterized by the fact that a jet (7) of molten amorphizable alloy (4) is contacted with a gas (55) capable of reacting chemically with at least one of the components of the alloy (4) before the jet (7) reaches a cooling liquid (9), so as to form a layer around the jet (7) which is capable of stabilizing it. A distance traversed by the jet (7) between the nozzle and the cooling liquid is greater than 1 cm.

21 Claims, 4 Drawing Sheets

20
21
V
V
L
7
O
80
12
10
8
9
11
x
x'

20
21
IV
IV
11
8
10
x'
x
7
12
O
F11

METHODS AND APPARATUS FOR OBTAINING WIRES OF AMORPHOUS METALLIC ALLOYS

BACKGROUND OF THE INVENTION

The present invention concerns wires of amorphous metallic alloys and, in particular, methods and apparatus which make it possible to obtain wires of amorphous metallic alloys by rapid cooling in a liquid medium, these alloys having, in particular, a base of iron.

It is known to produce amorphous wires by spraying a jet of molten alloy into a liquid cooling layer, for instance, a layer of water applied by centrifugal force against the inner wall of a rotary drum or against the bottom of a moving belt. Such methods are described, for instance, in U.S. Pat. Nos. 3,845,805 and 4,523,626.

These methods have the following drawbacks:

The projected jet has a tendency to resolve itself into drops, which results either in discontinuity of the jet, leading to the impossibility of having a continuous wire or in the formation of a continuous wire of irregular cross section.

In order to avoid this resolution into drops it is necessary to satisfy the following operating conditions in the case of iron-base alloys:

The distance between the outlet nozzle of the molten metal and the water must be small, less than about 3 mm.

The rate of ejection of liquid metal must be high, equal to at least about 8 meters per second, that is to say, the pressure of the gas used to project the metal through the nozzle must be high, at least equal to 3.5 bars.

Moreover, the temperature difference between the molten metal and the outside environment is very high and, due to the small distance between the nozzle and the water, it is not possible to use parts which make it possible to insulate and reinforce the nozzle and the reservoir containing the molten amorphizable alloy. It is therefore necessary to use only special materials, such as silica, which withstand high heat gradients well but, on the other hand, support pressure poorly, so that the pressure of the gas used to project the metal through the nozzle is less than 5 bars. There results from this, in general, a speed of the jet which is less than 10 meters per second, which can lead to a lack of regularity of the jet and to a low speed of manufacture of the wire.

The production of the wire therefore requires a very precise compromise between operating characteristics, a compromise which is very difficult to satisfy in industrial manufacture.

Finally, in the event that a rotary drum is used having a layer of water applied against the inner wall of the drum by centrifugal force, then, in view of the small distance which must be provided between the nozzle and the water, the reservoir from which the jet comes must be located within the drum so that, for considerations of space, the capacity of the reservoir cannot be greater than about 500 g of metal and the length of the wire produced is necessarily limited.

The French patents published under Nos. 2,136,976, 2,230,438 and 2,367,563, as well as the article entitled "Production of fine wires from liquid steel" by Massoubre, Pflieger et al., published in the Revue de Metallurgie for March, 1977 described a method of manufacturing steel wires by cooling a jet of molten metal to solidification in a gaseous atmosphere, the jet being stabilized by a superficial oxidation reaction. This process requires a very long length of path in said gaseous atmosphere in order to obtain the solidification, and it is not adapted to the production of wires of amorphous alloys, since the speed of hardening is not sufficient.

SUMMARY OF THE INVENTION

The object of the present invention is to remedy these drawbacks.

Accordingly, the invention concerns a method for obtaining a wire of amorphous metallic alloy, which method consists in producing a jet of a molten amorphizable alloy through a nozzle and introducing the jet into a cooling liquid so as to obtain rapid solidification of the jet to produce the amorphous metal wire, the method being characterized by the following points:

(a) Before the jet arrives in the cooling liquid, it is contacted with a gas capable of reacting chemically with at least one of the components of the alloy;

(b) This reaction takes place superficially, so as to form around the jet a layer which is capable of stabilizing it;

(c) The distance traversed by the jet between the nozzle and the cooling liquid is greater than 1 cm.

The invention also concerns an apparatus for obtaining a wire of amorphous metallic alloy, said apparatus comprising a reservoir capable of containing an amorphizable alloy in liquid state, a nozzle, and means for applying pressure in order to cause the liquid alloy to flow through the nozzle in the form of a jet in the direction towards a cooling liquid which is capable of permitting rapid solidification of the jet, which then produces the amorphous metallic wire, the apparatus being characterized by the following features:

(a) It comprises an enclosure located between the reservoir and the cooling liquid, the jet passing through said enclosure before arriving at the cooling liquid; this enclosure is adapted to contain a gas which can react chemically with at least one of the components of the alloy;

(b) This reaction takes place superficially, so as to form around the jet a layer which is capable of stabilizing the jet;

(c) The nozzle and the enclosure are so arranged that the distance traversed by the jet between the nozzle and the cooling liquid is greater than 1 cm.

The invention also concerns amorphous wires obtained by the method or apparatus according to the invention. These wires can be used, for instance, in order to reinforce plastic or rubber articles, in particular pneumatic tires, and the invention also concerns such articles.

DESCRIPTION OF THE DRAWINGS

The embodiments which follow, as well as the figures of the drawing corresponding to these embodiments, all of which are diagrammatic, are intended to illustrate the invention and facilitate an understanding thereof, without however delimiting its scope.

In the drawings.

PRIOR ART

Figure 2:
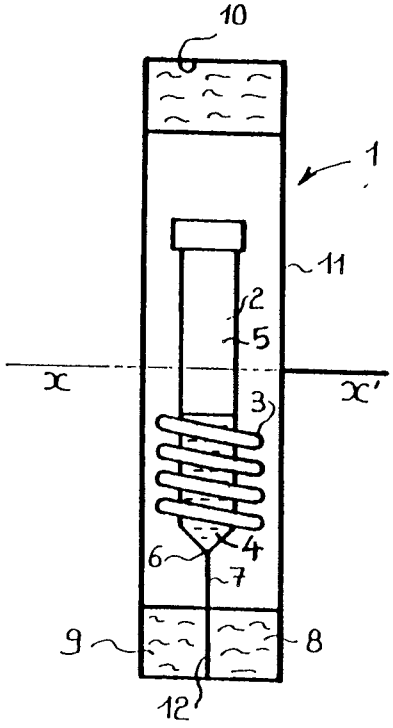
FIG. 2 shows the apparatus of FIG. 1 in section along a plane containing the axis of rotation of the drum, the section of FIG. 2 being indicated diagrammatically by the section line II—II in FIG. 1.
Figure 1:
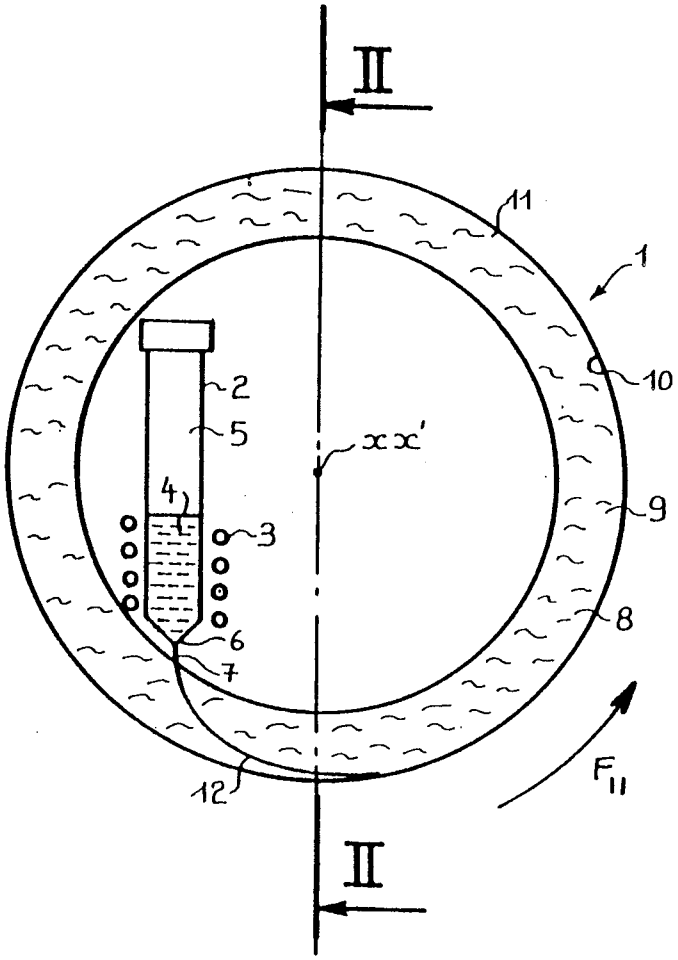
FIG. 1 shows a known apparatus for obtaining an amorphous wire, this apparatus comprising a rotary drum, FIG. 1 being a section along a plane perpendicular to the axis of rotation of the drum.

FIGS. 1 and 2 show a known apparatus for the production of amorphous metal wires. This apparatus 1 comprises a reservoir 2 consisting of a crucible around which there is present the induction coil 3 which makes it possible to melt the amorphizable metal alloy 4 having a base of iron which is arranged within the reservoir 2. A gas 5 under pressure, for instance argon, makes it possible to force the liquid alloy 4 to flow through the nozzle 6 so as to obtain a jet 7, this gas 5 being inert with respect to the alloy 4. The jet 7 arrives at the layer 8 of cooling liquid 9 which is applied against the inner wall 10 of a drum 11, this liquid 9 being, for instance, water. The jet 7 then solidifies very rapidly to form the amorphous metal wire 12. The drum 11 turns around its axis in the direction indicated by the arrow F11, this axis being marked xx', and the centrifugal force thus obtained applies the cooling liquid 9 in the form of the regular cylindrical layer 8 against the inner wall 10. FIG. 1 is a section perpendicular to the axis xx', and FIG. 2 is a section in a plane passing through the axis xx', this plane being indicated by the line segments II—II in FIG. 1.

The jet 7 has a tendency to resolve itself into drops before it enters the layer 8. In order to avoid this resolution into drops, it is necessary to satisfy the following operating conditions:

The distance between the nozzle 6 and the layer 8, that is to say the length of jet 7, must be short, less than about 3 mm;

The rate of ejection of the jet 7 must be high, at least equal to about 8 meters per second, that is to say the pressure of the gas 5 must be high, at least equal to 3.5 bars;

The difference in temperature between the molten metal 4 and the air surrounding the reservoir 2 is very high, and, due to the small distance between the nozzle 6 and the water 9, it is not possible to use parts which make it possible to insulate the nozzle 6 and the reservoir 2. One can only use a refractory material such as silica, which is of poor resistance to pressure; the pressure of the argon 5 is therefore less than about 5 bars and the speed of the jet 7 is less than 10 meters per second, which can lead to a lack of uniformity of the jet 7 and to a low speed of manufacture of the wire 12;

The production of the wire 12 therefore requires a very careful compromise between the operating characteristics; this compromise is very difficult to satisfy in industrial manufacture, and it is not always possible to find it;

The reservoir 2 must be located within the drum 11 and its capacity must be small, at most equal to about 500 g; the length of the wire 12 is therefore necessarily limited.

PREFERRED EMBODIMENTS OF THE INVENTION

Figure 4:
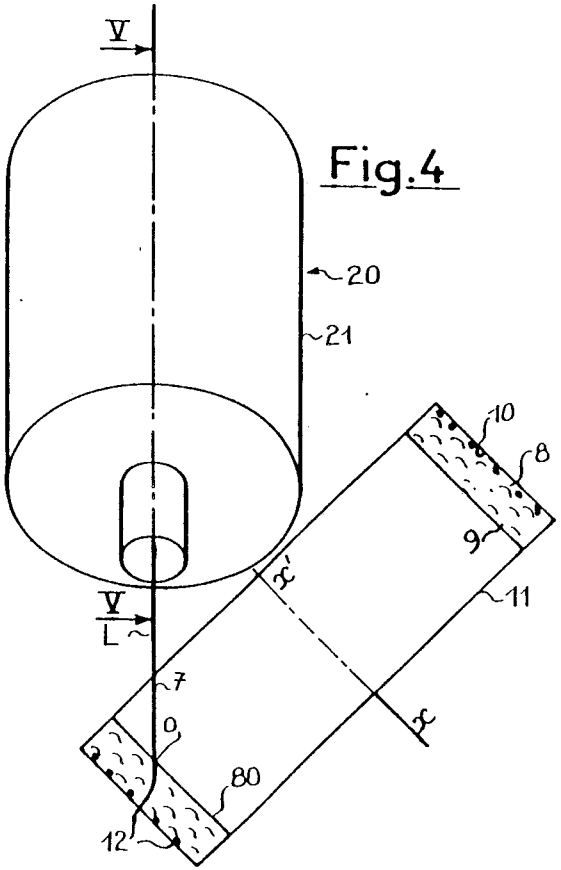
FIG. 4 shows the apparatus of FIG. 3 in section along a plane passing through the axis of rotation of the drum, this section being indicated schematically by the section line IV—IV in FIG. 3.
Figure 3:
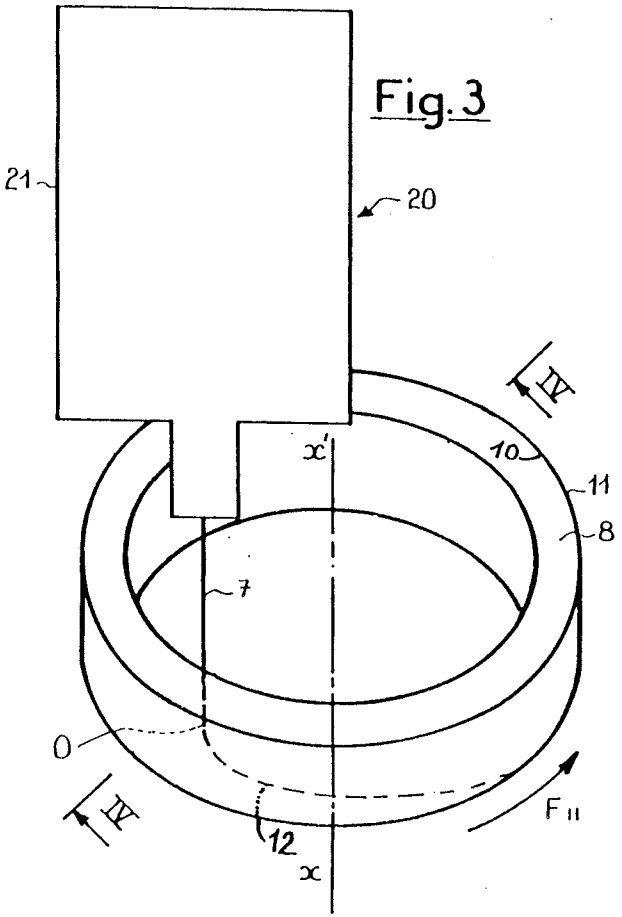
FIG. 3 shows, in profile, an apparatus according to the invention, which apparatus comprises a rotary drum and a pouring installation.

FIGS. 3 and 4 show an apparatus 20 in accordance with the invention. The apparatus 20 comprises the rotary drum 11 with axis of rotation xx' and the pouring installation 21 which makes it possible to project a jet 7 of molten metal into the layer 8 applied by centrifugal force against the inner wall 10 of the drum 11.

Figure 5:
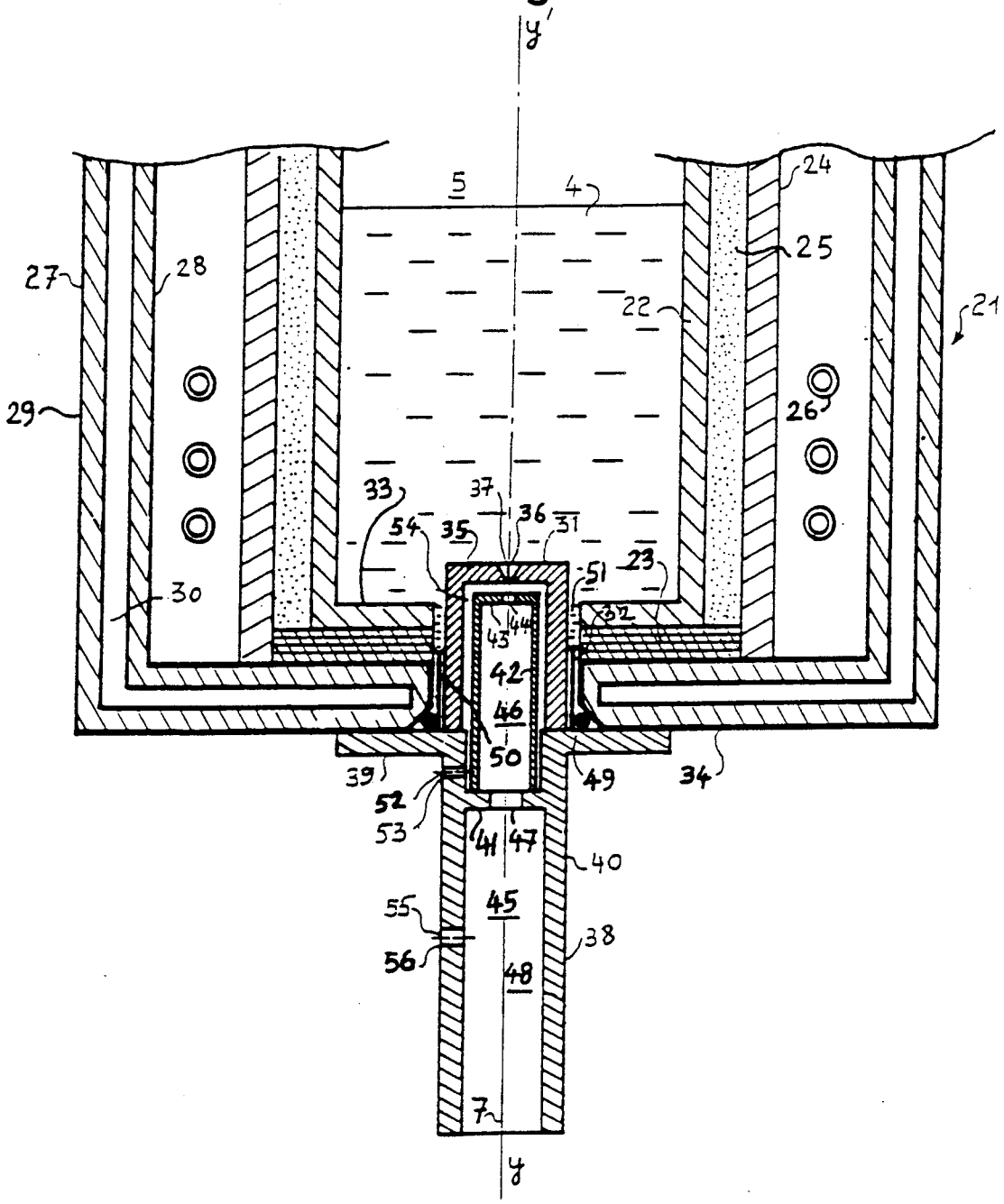
FIG. 5 shows in detail the pouring installation of the apparatus shown in FIGS. 3 and 4, FIG. 5 being a section along a plane passing through the axis of this installation, this section being indicated diagrammatically by the section line V—V in FIG. 4.

FIG. 3 is a profile view and FIG. 4 is a section along a plane passing through the axis of rotation xx' and through the point of contact 0 of the jet 7 with the layer 8, this section being indicated diagrammatically by the section line IV—IV in FIG. 3. A part of the installation 21 is shown in detail in FIG. 5, this FIG. 5 being a section taken along a plane passing through the axis yy' of the installation 21, the section of FIG. 5 being indicated diagrammatically by the section line V—V in FIG. 4.

The installation 21 is arranged outside the drum 11. This installation 21 comprises a reservoir 22 formed of a ceramic crucible, for instance a crucible of zircon or alumina. The crucible 22 rests on the insulating cross member 23 made, for instance, of refractory aluminous concrete. Around the crucible 22 there is arranged a cylindrical jacket 24 made, for instance, of zircon. Between the crucible 22, the cross member 23 and the jacket 24 there is a padding 25 in the form of compacted alumina powder. The jacket 24 is surrounded by the induction coil 26 which is capable of melting the amorphizable alloy 4, having a base of iron, by the passage of an electric current. The assembly consisting of the crucible 22, the cross member 23, the jacket 24 and the padding 25 is surrounded by an enclosure 27 comprising two walls 28, 29 of steel, a cooling liquid 30, for instance water, being arranged between these walls 28, 29. A part 31 in the form of an inverted cup is arranged within the opening 32 passing through the bottom 33 of the crucible 22 and the bottom 34 of the enclosure 27. The cross member 23 and the jacket 24 rest directly on the bottom 34 of the enclosure 27. The cup 31 is made, for instance, of zircon. The top 35 of the cup 31 is traversed by a nozzle 36 made, for instance, of zirconia or alumina, the part 31 therefore serving as support for the nozzle 36. The opening 37 of said nozzle 36 is arranged along the axis yy', which is the axis of the opening 32 and the axis of the installation 21. The installation 21 furthermore comprises a device 38 having the flange 39, which makes it possible to apply this device against the enclosure 27. The device 38 furthermore comprises a cylindrical enclosure 40 and the annular rim 41 on which there is applied a part 42 having the shape of an inverted cup, the top 43 of which has an opening 44 located below the opening 37 of the nozzle 36 and having the axis yy'. The flange 39, the cylinder 40 and the rim 41 are made, for instance, of steel and the part 42 is made of ceramics, for instance of zircon. The inner volume 45 of the cylinder 40 below the rim 41 and the inner volume 46 of the cup 42 communicate with each other via the opening 47 and together constitute the enclosure 48.

The tightness at the level of the flange 39 is assured by a toric joint 49, for instance of rubber.

The operation of the apparatus 20 is as follows:

The passage of the electric current in the induction coil 26 permits the melting of the amorphizable alloy 4 contained in the crucible 22. This molten alloy 4 makes it possible to melt the upper part of a ring of steel 50 previously arranged around the support 31 between said support 31, on the one hand, and the crucible 22, the enclosure 27 and the cross member 23 on the other hand. This partial fusion of the ring 50 forms the steel joint 51 between the support 31 and the crucible 22. This joint 51, combined with the toric joint 49, assures good tightness of the installation 21. The argon 5 under pressure, which is arranged in the crucible 22 above the alloy 4, permits the extrusion of said alloy through the nozzle 36 in the form of a jet 7 which passes through the opening 44 of the part 42 along the axis yy' and traverses the inner volumes 46 and 45, that is to say the enclosure 48, and then emerges from the installation 21 and arrives in the layer 8 of water 9, where it solidifies very rapidly to form the wire 12. The speed of hardening is, in known manner, on the order of 105° C. per second, the water 9 being cooled by a known cooling system arranged around the drum 11, this system not being shown in the drawing for purposes of simplification. A small amount of hydrogen 52 is introduced through the opening 53 provided in the cylinder 40 above the rim 41. The hydrogen 52 thus fills the space 54 which is present on the outside of the cup 42 between the latter and the support 31, the cylinder 40 and the rim 41. The hydrogen 52 is therefore in contact with the nozzle 36.

A gas 55 capable of reacting chemically with at least one of the components of the alloy 4 is introduced, this gas 55 being, for instance, a mixture of hydrogen and water vapor, it being fed through the opening 56 provided in the cylinder 40 below the rim 41. This mixture 55 thus fills the inner volumes 45, 46, that is to say the enclosure 48. The hydrogen 52 emerges through the opening 44 into the enclosure 48. The hydrogen is burned at the outlet from the cylinder 40 upon its passage into the ambient air for considerations of safety, so that, upon the operation of the apparatus 20 a stream of hydrogen 52 is maintained through the opening 53 and a stream of mixture 55 of hydrogen and steam through the opening 56. The gaseous mixture 55 is capable, upon contact with the jet 7, which is at high temperature, of oxidizing at least one element of the alloy 4, in particular the silicon. This reaction takes place superficially and forms a very fine superficial layer, which makes it possible to stabilize the jet 7, this jet remaining liquid in its mass. The presence of hydrogen 52 in contact with the nozzle 36 makes it possible to protect the nozzle against any action of the mixture 55. The phenomenon which makes it possible to stabilize the jet 7 is complicated; it is probably due to the fact that the superficial oxidation takes place by a lowering of the surface tension and an increase of the surface viscosity as a result of a submicroscopic oxidized superficial layer of a thickness of less than 0.1 μm. Due to this stabilization, the length L of the jet 7 between the nozzle 36 and the layer 8 may easily exceed 1 cm, this length L being preferably between 10 cm and 1 m. This permits the following advantages:

The fact of being able to move the nozzle 36 away from the water 9 makes it possible to have available a large volume for arranging parts, which makes it possible to improve the thermal and mechanical resistance of the installation 21. As a matter of fact, the cross member 23, the jacket 24 and the padding 25 permit good thermal insulation of the crucible 22. Furthermore, support 31 may be of a large length parallel to the axis yy', which avoids excessive thermal stresses for the support 31, and the presence of this elongated support 31 and of the cup 42 makes it possible properly to heat-insulate the nozzle 36. Finally, the steel enclosure 27 makes it possible to have good mechanical strength of the assembly, the presence of all these parts being possible due to the large length L. This improvement in the thermal and mechanical resistance of the installation 21 makes it possible to increase the pressure of the gas 5, which may exceed 5 bars, the speed of the jet 7 being capable therefore of exceeding 10 meters per second.

The installation 21 and therefore the crucible 22 are arranged on the outside of the drum 11; it is therefore possible to use a crucible 22 of large volume and thus to use a large amount of alloy 4, far greater than 500 g, so that the length of wire 12 can be substantial.

The distance L between the nozzle 36 and the layer 8 can vary within wide limits, which results in great flexibility in the adjustments of the installation 21 with respect to the drum 11 and in particular with respect to the direction of the jet 7 with regard to the surface 80 arranged towards the axis xx', of the layer 8.

The stabilization of the jet 7 makes it possible to employ, if desired, low pressures of gas 5, for instance less than 3.5 bars, and therefore low speeds of jet 7, for instance less than 8 meters per second, which further favors the flexibility of the adjustments of the apparatus 20 as a result of the flexibility in the selection of the pressures. A low speed of the jet 7 is, for example, necessary in the event that the kinetics of the oxidation reaction are slow, the invention permitting good continuity of the jet 7 even in this case.

Finally, the apparatus 20 makes it possible to extend the composition range of alloys with which it is possible to obtain an amorphous wire 12. As a matter of fact, the known apparatus, for instance the apparatus 1, do not make it possible to obtain amorphous wires from alloys comprising iron, silicon and boron, or iron, nickel, silicon and boron if the silicon content is less than 5% (atomic percent), since in such case only balls are obtained. On the other hand, the invention does make it possible to obtain amorphous wires from such alloys even if the silicon content is less than 5% (atomic percent), due to the oxidizing gas 55.

In order that the jet 7 can undergo a very rapid hardening in the layer 8 so as to obtain an amorphous wire 12, it is essential that the jet 7 remain liquid over the entire length L, that is to say the jet 7 must be at a temperature greater than the melting point of the alloy 4 upon the impact of the jet 7 with the water 9. The hydrogen 52 and the oxidizing gaseous mixture 55 therefore must not cool the jet 7 substantially, the solidification being effected solely within the layer 8 when the alloy 4 contains silicon, and when the stabilization of the jet 7 is effected by oxidation of the silicon, the silicon content in the alloy 4 must preferably be greater than 0.2% (atomic percent).

The jet 7 flows, for instance, form top to bottom, as in the apparatus 20 previously described, in vertical direction, and the axis xx' of the drum 11, and therefore the generatrices of the cylinder of water 80 limiting the layer 8 in the direction of the axis xx', form an angle of 40° to 70° with the vertical. However, one can contemplate having the jet 7 discharge in other directions at the outlet of the installation 21, for instance horizontally or from the bottom to the top.

By way of example, the characteristics of the apparatus 20 are as follows:

Diameter of the drum 11: 47 cm;

Angle of the axis xx' with respect to the vertical: 45°;

Linear speed of rotation of the surface 80: of the same order of magnitude as that of the jet 7;

Thickness of the layer of water 8: 0.5 to 3 cm;

Crucible 22 of a volume for 3 kg of amorphizable alloy 4;

Diameter of the opening 37 of the nozzle 36: 165 μm;

Temperature of the water 9: 5° C.;

This apparatus 20 is used to carry out the following two tests:

First test:

Composition of alloy 4=$Fe_{78}Si_9B_{13}$, that is to say 78% Fe, 9% Si, 13% B (atomic percentages). Melting point of this alloy: 1170° C. Temperature of the alloy 4 in the crucible 22: 1200° C. Pressure of the gas 5: 5 bars. Speed of the jet 7 upon emergence from the nozzle 36: 10 meters per second. Distance between the nozzle 36 and the layer 8=30 cm, this distance being equal to the length L of the jet 7 from the nozzle 36 to the layer 8.

Second test:

Composition of the alloy 4: $Fe_{58}Ni_{20}Si_{10}B_{12}$, that is to say 58% Fe, 20% Ni, 10% Si, 12% B (atomic percentages). Melting point of this alloy: 1093° C. Temperature of the alloy 4 in the crucible 22: 1130° C. Pressure of the gas 5=10 bars; speed of the jet 7=14 meters per second. Distance between the nozzle 36 and the layer 8: 30 cm, this distance being equal to the length L of the jet 7 from the nozzle 36 to the layer 8.

In these two tests, the jet 7 is continuous during its entire path from the nozzle 36 to the layer 8, without formation of drops. This, combined with the very rapid cooling effected as a result of the layer 8, makes it possible to obtain an amorphous wire 12 whose circular cross section of a diameter of 160 μm has a uniform shape over its length.

The crucible 22 has been shown as a reservoir in which the melting of the alloy 4 is effected, but one could use a reservoir fed with previously molten alloy 4, this feed being, for instance, continuous.

In the apparatus 20, the installation 21 has been described as being outside the drum 11, but the invention is still of interest if the means making it possible to obtain the jet 7 are arranged inside the drum 11, utilizing a smaller length L, for instance on the order of 2 cm, which still permits great flexibility in the adjustment of the pouring while protecting these means thermally and mechanically.

Figure 7:
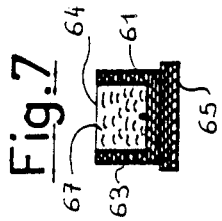
FIG. 7 shows a portion of the belt of the apparatus shown in FIG. 6, FIG. 7 being a section taken along a transverse plane, the section in FIG. 7 being indicated diagrammatically by the section line VII—VII in FIG. 6.
Figure 6:
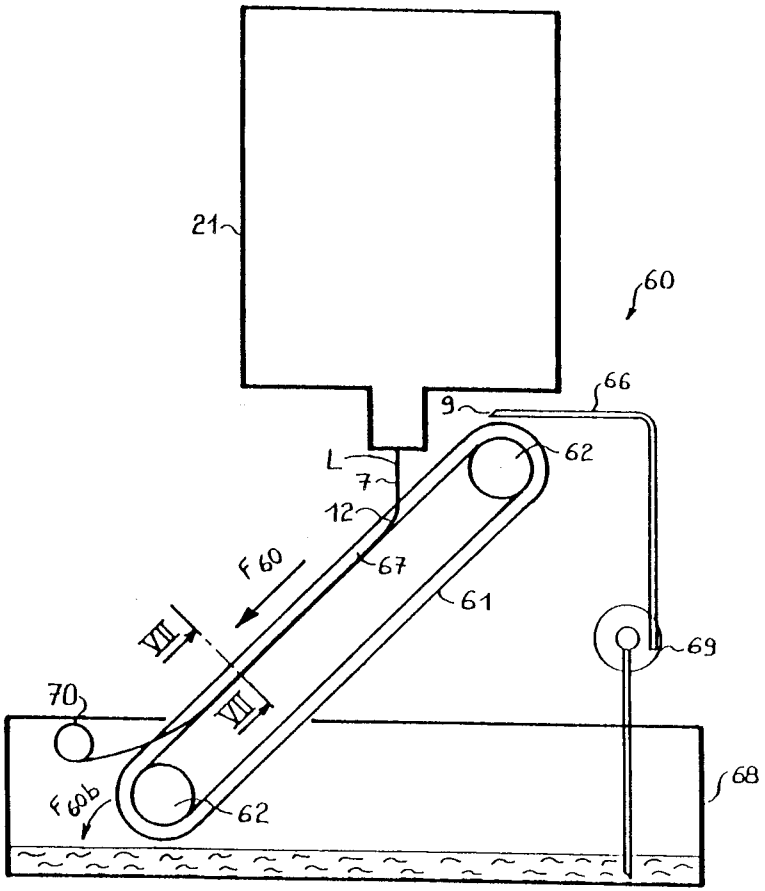
FIG. 6 shows another apparatus according to the invention, which comprises a belt, FIG. 6 being a section through a plane along the length of the belt.

The embodiments described above concern the use of a layer 8 of water formed by the centrifugal force within a rotary drum, but the invention applies also to the case in which other types of layers of cooling liquid are used, for instance when a movable belt is used as support for the cooling liquid, as shown in FIGS. 6 and 7.

The apparatus 60 shown in FIG. 6 comprises the installation 21 described above and the belt 61 supported by the rollers 62. FIG. 6 is a section along the length of the belt 61 and FIG. 7 shows a part of the belt 61 in cross section, the plane of the cross section of FIG. 7 being indicated diagrammatically by the line segments VII—VII in FIG. 6. The rollers 62 permit the belt 61 to move at the upper part in the direction indicated by the arrow F60, this arrow being inclined downward. The cross section of the upper part of the belt, shown in FIG. 7, comprises two elements, an element 63 which has the shape of an upward-facing U so as to form a channel 64, the element 63 being applied on a lower support 65 of rectangular cross section, said support 65 being reinforced in order to assure the necessary rigidity. A cooling liquid 9, for instance water, is caused to arrive at the top of the upper part of the belt 61 through the pipe 66. The water 9 is carried along downward by the belt 61 at the same speed as the belt, and thus forms a layer 67 in the channel 64. The water 9 then flows into the vat 68, this flow being diagrammatically indicated by the arrow $F_{60b}$. The water 9 is then returned to the pipe 66 by means of the pump 69, and again poured onto the belt 61.

The installation 21 makes it possible to introduce the jet 7 into the layer 67, where it is rapidly hardened to form the amorphous wire 12. The wire 12 flows with the water 9 in the direction indicated by the arrow $F_{60}$ and is then wound on the bobbin 70 in the vicinity of the lower part of the belt 61.

The invention furthermore makes it possible here again to obtain in the apparatus 60 a high speed for the jet 7 and great flexibility for the arrangement of the installation 21 due to the substantial length L between the nozzle 36 and the layer 67, with the advantages described above which result therefrom.

Of course, the invention is not limited to the embodiments previously described and thus, in particular, one can have the following arrangements:

Other oxidizing gases than the hydrogen/steam mixture can be used, for instance a mixture of hydrogen and carbon dioxide or hydrogen and carbon monoxide, or a mixture of hydrogen with at least two oxidizing compounds selected from among steam, carbon dioxide, and carbon monoxide; oxygen can also, for instance, be used as oxidizing gas, or else a mixture containing oxygen, for instance air;

The hydrogen can also be replaced by another gas, for instance an inert gas, in particular nitrogen or argon;

The protection of the nozzle can be assured by gases other than hydrogen; one can even contemplate dispensing with such protection if the nozzle is resistant to the gaseous atmosphere capable of stabilizing the jet; in this case, for alloys the stabilization of the jet of which it is difficult to effect, it may be advantageous to introduce the oxidizing gas in contact with the jet directly upon the emergence from the nozzle;

The expression "oxidation" is to be understood in a broad sense and includes reactions leading to compounds other than oxides, for instance chalcogenides, such as sulfides; one can even contemplate other chemical reactions besides oxidation for the stabilization of the jet, for instance a nitriding.

We claim:

1. A method of obtaining a wire of an amorphous metallic alloy which includes the steps of producing a jet of a molten amorphizable alloy through a nozzle and introducing the jet into a cooling liquid so as to obtain a rapid solidification of the jet which then gives the amorphous metal wire, the method being characterized by the following features:

(a) before the jet arrives at the cooling liquid, contacting the jet with a reactive gas which reacts chemically with at least one of the components of the alloy;

(b) forming by this reaction a stabilizing superficial layer around the jet; and (c) maintaining a distance traversed by the jet between the nozzle and the cooling liquid of greater than 1 cm.

2. A method according to claim 1, characterized by the fact that the distance traversed by the jet between the nozzle and the cooling liquid is between 10 and 100 cm.

3. A method according to either of claims 1 or 2, characterized by the fact that the reaction is an oxidation.

4. A method according to claim 3, characterized by the fact that the alloy contains silicon, the oxidation taking place on this silicon.

5. A method according to claim 4, characterized by the fact that the alloy contains more than 0.2% silicon in atomic percentage.

6. A method according to claim 3, characterized by the fact that the gas is a gaseous mixture comprising a gas selected from the group consisting of hydrogen and an inert gas and at least one other gas selected from the group consisting of steam, carbon dioxide and carbon monoxide.

7. A method according to claim 1, characterized by the fact that the jet is obtained by applying a gas which is inert to the alloy onto the molten alloy upstream of the nozzle, the pressure of said gas being at least equal to 5 bars and the speed of the jet being at least equal to 10 meters per second.

8. A method according to claim 1, characterized by the fact that the jet is obtained by applying a gas which is inert to the molten alloy upstream of the nozzle, the pressure of said gas being less than 3.5 bars and the speed of the jet being less than 8 meters per second.

9. A method according to claim 1, characterized by the fact that the jet is introduced into a layer of cooling liquid which is applied by centrifugal force against the inner wall of a rotary drum.

10. A method according to claim 9, characterized by the fact that the jet is obtained with means which are arranged on the outside of the drum.

11. A method according to claim 1, characterized by the fact that the jet is introduced into a layer of cooling liquid which is entrained by a movable belt.

12. A method according to claim 1, characterized by the fact that the nozzle is protected with a gas on the jet side.

13. An apparatus for obtaining a wire of amorphous metallic alloy, said apparatus comprising a reservoir capable of containing an amorphizable alloy in liquid state, a nozzle, means to apply a pressure in order to cause the liquid alloy to flow through the nozzle in the form of a jet in the direction towards a cooling liquid capable of permitting rapid solidification of the jet, which then produces the amorphous metallic wire, the apparatus further comprising a cooling liquid container, an enclosure located between the reservoir and the cooling liquid container, the jet passing through said enclosure before being introduced into the cooling liquid within the cooling liquid container, and a passage in communication with a source of reactive gas for introducing the reactive gas within said enclosure for reacting chemically with at least one of the constituents of the alloy, the reaction taking place superficially so as to form a layer around the jet capable of stabilizing it, the liquid metal jet forming nozzle and the cooling liquid within the cooling liquid container being spaced apart so that the distance traversed by the jet between the nozzle and the cooling liquid is greater than 1 cm.

14. An apparatus according to claim 13, characterized by the fact that the distance between the nozzle and the cooling liquid is between 10 and 100 cm.

15. An apparatus according to claim 13, characterized by the fact that the enclosure contains a gaseous mixture comprising a gas selected from the group consisting of hydrogen and an inert gas and at least one other gas selected from the group consisting of steam, carbon dioxide and carbon monoxide.

16. An apparatus according to claim 13, characterized by the fact that the reservoir contains a gas which is inert to the alloy and the pressure of which is at least equal to 5 bars, this gas under pressure making it possible to obtain a speed of the jet of at least 10 meters per second.

17. An apparatus according to claim 13, characterized by the fact that the reservoir contains a gas which is inert to the alloy the pressure of which is less than 3.5 bars, this gas under pressure making it possible to obtain a speed of the jet less than 8 meters per second.

18. An apparatus according to claim 13, characterized by the fact that the cooling liquid container comprises a rotary drum capable of forming a layer of the cooling liquid applied by centrifugal force against the inner wall of the drum, the jet being introduced into said layer.

19. An apparatus according to claim 18, characterized by the fact that the reservoir is outside of and separated from the drum.

20. An apparatus according to claim 13, characterized by the fact that it comprises a movable belt capable of entraining a layer of the cooling liquid, the jet being introduced into said layer.

21. An apparatus according to claim 13, characterized by the fact that it comprises means for bringing a gas into contact with the nozzle, on the jet side, in order to protect it.

* * * * *